United States Patent [19]

Ohba

[11] Patent Number: 4,997,299

[45] Date of Patent: Mar. 5, 1991

[54] COSMETIC CONTAINER

[75] Inventor: Atsushi Ohba, Tokyo, Japan

[73] Assignee: Suzuno Kasei Co., Ltd., Tokyo, Japan

[21] Appl. No.: 440,549

[22] Filed: Nov. 21, 1989

[51] Int. Cl.[5] ..... B43K 21/08

[52] U.S. Cl. ..... 401/75; 401/171; 401/172; 401/174

[58] Field of Search ..... 401/68, 69, 75, 76, 401/77, 78, 81, 171, 172, 174

[56] References Cited

U.S. PATENT DOCUMENTS

| | | | |
|---|---|---|---|
| 1,425,871 | 8/1922 | Liddell | 401/75 X |
| 1,797,888 | 3/1931 | Wahl | 401/75 X |
| 1,924,256 | 8/1933 | Richards | 401/75 X |
| 2,023,865 | 12/1935 | Weaver et al. | 401/75 X |
| 2,356,509 | 8/1944 | Deli | 401/75 |
| 3,358,699 | 12/1967 | Bau | 401/75 X |
| 4,610,557 | 9/1986 | Malm | 401/78 X |
| 4,904,101 | 2/1990 | Petterson | 401/78 X |

FOREIGN PATENT DOCUMENTS

| | | | |
|---|---|---|---|
| 422767 | 1/1935 | United Kingdom | 401/75 |
| 1222448 | 2/1971 | United Kingdom | 401/68 |

*Primary Examiner*—Danton D. DeMille

*Attorney, Agent, or Firm*—Jordan and Hamburg

[57] ABSTRACT

The invention provides a cosmetic container which allows the cosmetic-loaded cartridge to be freely inserted into and removed from the container body featuring the provision of the following; an internal cylinder which has a spiral groove over the inner circumferential surface and is placed inside the container body; a push rod which moves in the axial direction inside the inner cylinder under the guidance of the spiral groove; a coil spring which loads the push rod in the retracting direction; a chuck which holds the cosmetic and which can be inserted by sliding into a slit guide cylinder inside the cartridge which can be freely inserted into the container body in the axial direction; a coil spring which forces the chuck into the innermost position; and inner spline teeth provided on the internal circumference of the guide cylinder and coupled to the projecting members on the external circumferential surface of the push rod, where the push rod moves forward under the guidance of the spiral groove following the rotation of the container body against the cartridge to eventually allow the cosmetic on the chuck to be extruded from the aperture at the tip of the cartridge.

16 Claims, 5 Drawing Sheets

COSMETIC CONTAINER

[BACKGROUND OF THE INVENTION AND RELATED ART STATEMENT]

The present invention relates to a cartridge-type cosmetic container, more particularly, to an improved cosmetic container holding either eyebrow pencils or eyeliners for example.

Nowadays from cosmetics products, there are some typical cartridge-type eyebrow pencil containers holding cartridges that can be replaced when required by easily inserting into and removing from the container body.

The consumer can optionally use cosmetic merely by replacing cartridges loaded with an assortment of cosmetics of different colors. Typically, such a conventional cosmetic container is provided with an extrusion mechanism which allows the cosmetic to change from the container by relatively rotating the container body against the cartridge and to retract into the container merely by reversing the rotation. In this case, since the movement of the cosmetic extrusion mechanism stops depending on the angular position of the container body, when replacing the cartridge, the user needs to first turn the extrusion mechanism of the container body until the mechanism is fully back to the initial position. If the user carelessly attempts to replace the cartridge without fully turning the extrusion mechanism back to the initial position, the internally-loaded cosmetic is damaged because it is forcibly driven out when the user inserts another cartridge into the container body, or the extrusion mechanism itself may incur damage. To prevent either of these, the user must proceed carefully with the replacement of the cartridge.

Actually, any one of these conventional cosmetic containers incorporates a complicated cosmetic-extrusion mechanism and a complicated mechanism for loading cosmetic-loaded cartridges, and thus, normally, the users cannot extrude the cosmetic smoothly and may easily damage the mechanism by forcibly rotating the container body.

[SUMMARY OF THE INVENTION]

The primary object of the invention is to provide a novel cosmetic container which allows users to easily replace the cosmetic-loaded cartridges.

The second object of the invention is to provide a novel cosmetic container which automatically brings the cosmetic-extrusion mechanism back to the initial position whenever replacing the cosmetic-loaded cartridge and allows it to retract into the container body.

The third object of the invention is to provide a novel cosmetic container which is composed mainly of a cartridge and a minimal number of components to allow manufactures to inexpensively and very easily assemble them.

The forth object of the invention is to provide a novel cosmetic container which allows the cosmetic to be smoothly extruded from the container and avoids malfunctions.

To achieve the objects stated above, the cosmetic container embodied by the invention features the provision of the following; an internal cylinder provided with a plurality of spiral grooves on the internal circumferential surface of the container body; a push rod which causes the interior of the internal cylinder to move in the axial direction under the guidance of the spiral grooves; a coil spring which loads the push rod in the retracting direction; a cartridge which can be freely inserted into the container body in the axial direction; a coupling member which allows the cartridge to be coupled with the container body so that both of these can rotate relatively with respect to each other; a guide cylinder placed inside the cartridge and provided with a plurality of slits extending in the axial direction; a chuck which holds the cosmetic and moves in the axial direction inside the guide cylinder under the guidance of these slits; another coil spring which loads the chuck until it reaches the innermost position; and inner spline teeth provided on the internal circumference of the guide cylinder and engage with the projecting members provided on the external circumferential surface of the push rod.

When the cartridge is loaded in the container body, the push rod approaches closely the back of the chuck and moves forward simultaneously with the relative rotation of the container body against the cartridge under the guidance of the spiral grooves in order to extrude the cosmetic on the chuck through the aperture at the tip of the cartridge.

When the cartridge is removed from the container body, the coil spring causes the push rod to automatically return to the initial position by rotating along the spiral grooves. In addition, the coil also causes the cosmetic to retract into the guide cylinder together with the chuck.

An O-ring is installed at an insert portion of the cartridge in such a way that it can remain in contact with the internal circumferential surface of the container body. The friction force generated by the contact of the O-ring with the inner circumference of the container body balances the axial repulsive force and the angular force between the cartridge and the container body caused by the repulsion of the coil spring.

The guide cylinder is made of elastically deformable material and allows the chuck to be loaded inside the guide cylinder via the slits having a width that can expand via the elastic deformation.

The coupling member coupling the cartridge to the container body is composed of a coupling ring attached to the internal cylinder and a ring-shaped groove provided on the external circumference of the guide cylinder. The inner diameter of the coupling ring secured to the ring step member on the internal circumference of the coupling ring can be easily and elastically deformed and expanded by means of the slits provided on the lateral surface of the guide cylinder.

Those and further characteristic features of the invention will be clarified more fully using the following description of the embodiments.

[DETAILED DESCRIPTION OF THE PREFERRED EMBODIMENTS]

Figure 1:
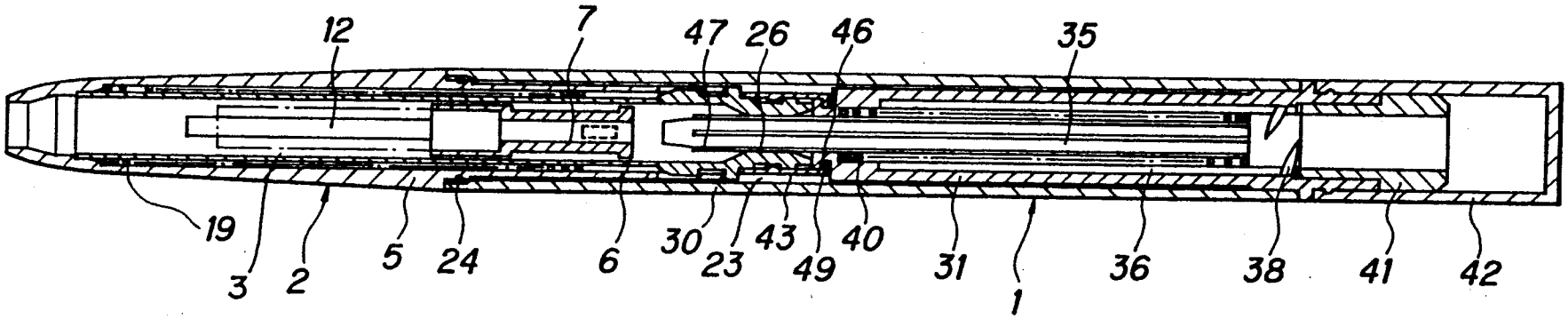
FIG. 1 illustrates a sectional view showing the whole assemble of the cosmetic container embodied by the invention.
Figure 2:
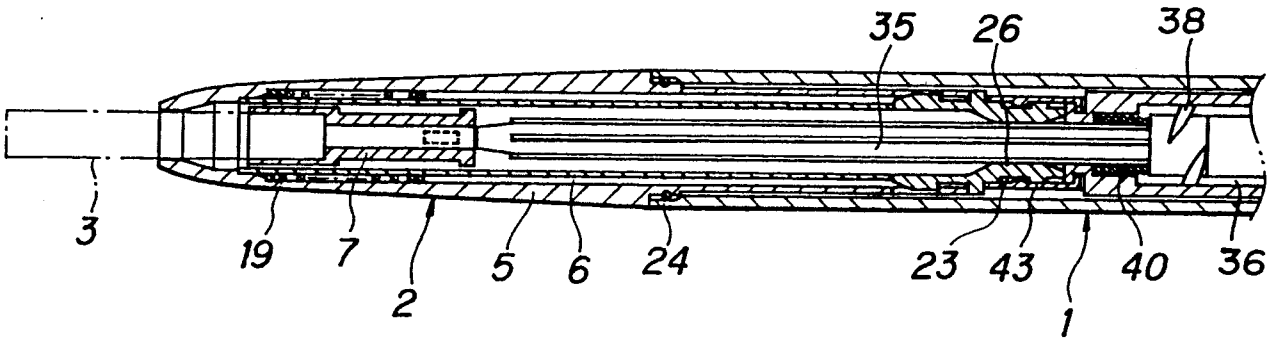
FIG. 2 illustrates a sectional view showing the operating condition of the cosmetic container embodied by the invention.
Figure 3:
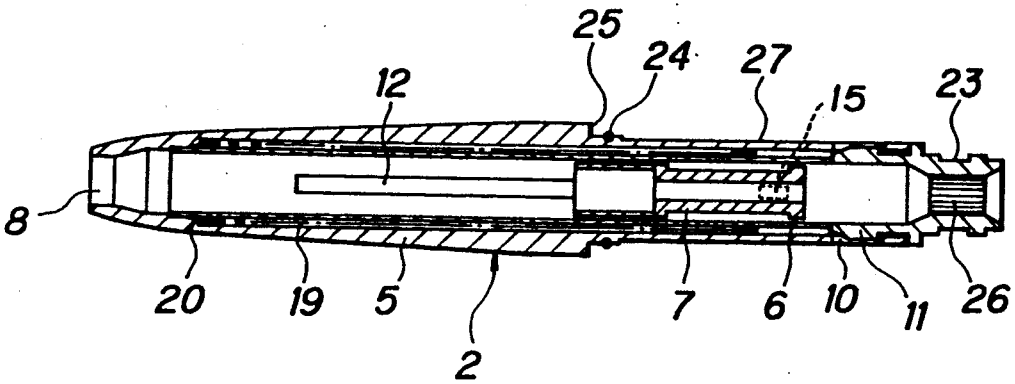
FIG. 3 illustrates a sectional view of the assembled cartridge.
Figure 4:
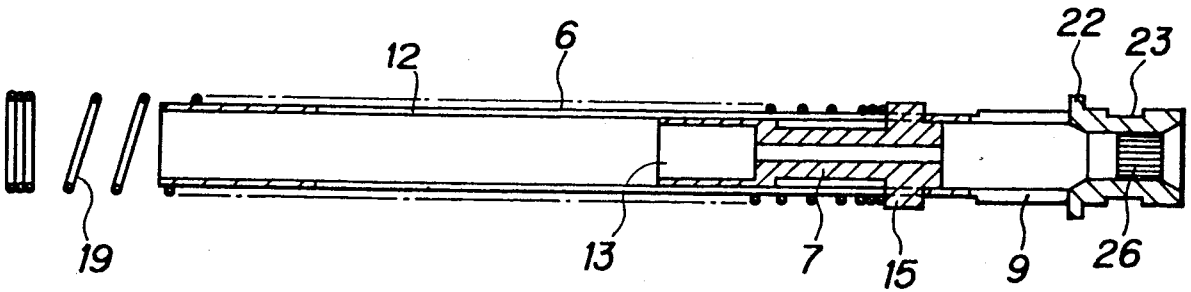
FIG. 4 illustrates a sectional view of the cartridge taken in a 90° direction and different from that on FIG. 3, where the chuck is loaded inside the guide cylinder which is placed in the cartridge.

The reference numerals 1 and 2 shown in FIGS. 1 and 2 respectively designate the container body and the cartridge which can be freely inserted into and removed from the container body. The cartridge 2 holds cosmetic 3 such as an eyebrow pencil for example. As shown in FIG. 3, the guide cylinder 6 is concentrically disposed inside the protection cylinder 5 having a tapered tip.

Chuck 7 securing cosmetic 3 is loaded in the guide cylinder 6, where the chuck 7 slides freely in the axial direction along the internal circumference of the guide cylinder 6. As a result, when the chuck 7 moves forward, part of cosmetic 3 is extruded from the aperture 8 at the tip of the protection cylinder 5.

Figure 5:
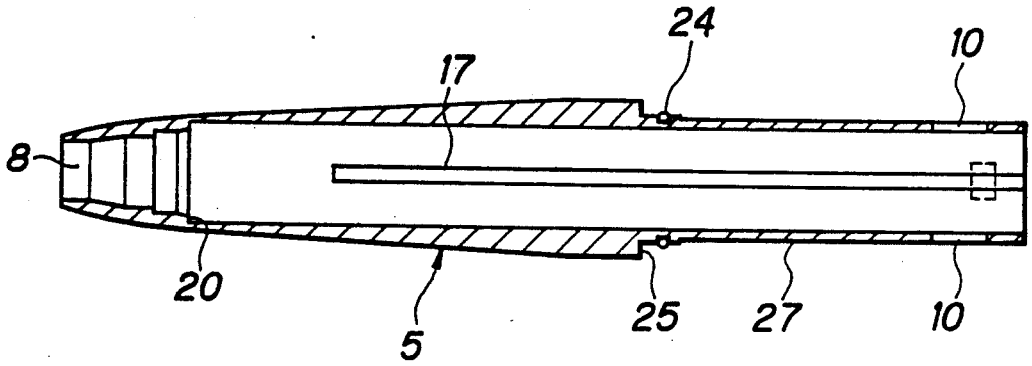
FIG. 5 illustrates a sectional view of the protection cylinder that protect the cartridge.
Figure 6:
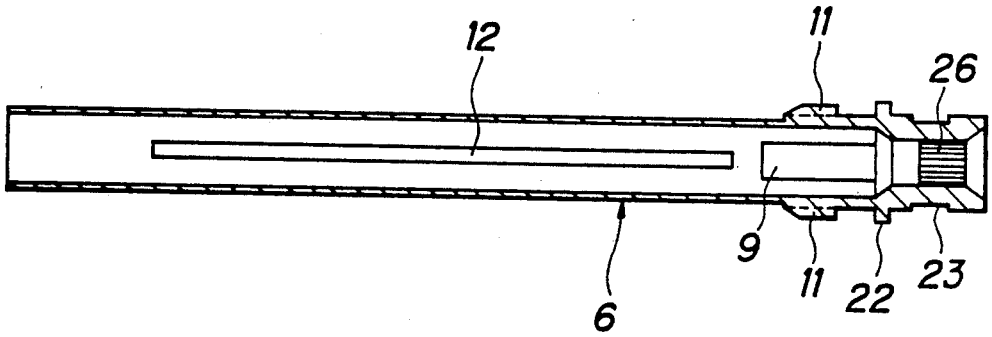
FIG. 6 illustrates a sectional view of the guide cylinder.

The guide cylinder 6 is inserted into the protection cylinder 5 until the cylinder 5 comes into contact with the collar member 22. To secure the guide cylinder 6 in a stable position by allowing part of the guide cylinder 6 to project from the rear edge of the protection cylinder 5, as shown in FIGS. 5 and 6, a pair of coupling holes 10 and 10 are provided at the rear edge of the protection cylinder 5, through which a pair of projecting members 11 and 11 are installed at the rear edge of the guide cylinder 6.

In this case, a pair of cutout windows 9 and 9 is provided at right angles between the projecting members 11 and 11. By virtue of the presence of the pair of cutout windows 9 and 9, when the coupling holes 10 and 10 are respectively coupled with the pair of the projecting members 11 and 11, after inserting the guide cylinder 6 into the protection cylinder 5, part of the projecting members 11 and 11 of the guide cylinder 6 is elastically displaced in the inward direction so that these parts can be smoothly coupled with the coupling holes 10 and 10.

As a result of the fitting of the projecting members 11 and 11 into the coupling holes 10 and 10, rotation of the guide cylinder 6 against the protection cylinder 5 is inhibited, and as described later on, the force applied to the guide cylinder 6 when removing the cartridge 2 from the container body 1 and the repulsive force of the coil spring 19 against the guide cylinder 6, are respectively received.

The round guide cylinder 6 is made of an easily and elastically deformable material such as plastics. A pair of slits 12 and 12 extending in the axial direction are provided on the circumferential lateral surface.

Figure 7:
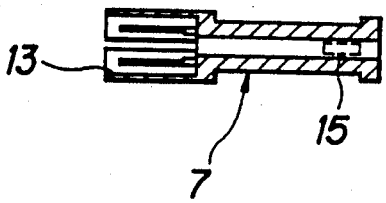
FIG. 7 illustrates a sectional view of the chuck.

As shown in FIGS. 3 and 7, the chuck loaded in the guide cylinder 6 is also of cylindrical shape. The insertion hole 13 is provided at the tip of the chuck 7 for loading cosmetic 3. A pair of projecting members 15 and 15 are installed at the rear edge of the chuck 7, where the pair of projecting members 15 and 15 respectively project out of the pair of slits 12 and 12. Accordingly, while guiding these projecting members 15 and 15 by the pair of slits 12 and 12, the chuck 7 slides in the axial direction inside the guide cylinder 6 within the extent of these slits 12 and 12.

Since the chuck 7 is made of a material which causes the guide cylinder 6 to easily and elastically deform, the chuck 7 can easily be loaded into the guide cylinder 6 merely by expanding the pair of slits 12 and 12.

The projecting members 15 and 15 of the chuck 7 are partially inserted into a pair of vertical grooves 17 and 17 which are provided on the internal circumference of the protection cylinder 5 at positions identical to those of slits 12 and 12 of the guide cylinder 6.

The coil spring 19 is attached to the external circumference of the guide cylinder 6. This coil spring 19 is set between the step 20 at the tip of the internal circumference of the protection cylinder 5 and the pair of projecting members 15 and 15 of the chuck 7 in a slightly compressed condition. The repulsive force of the coil spring 19 presses elastically the chuck 7 in the direction of the rear end of the pair of slits 12 and 12. Since the chuck 7 is led by the pair of slits 12 and 12 of the guide cylinder 6 by means of the pair of projecting members 15 and 15 on both sides of the chuck 7, the chuck 7 can slide smoothly without tilting.

As described later on, the chuck 7 is pushed forward by the push rod 35 which projects from the rear edge of the guide cylinder 6.

The cartridge 2 can easily be assembled without the use of special coupling tools and adhesive agents merely by preliminarily loading the chuck 7 into the guide cylinder 6, then inserting the guide cylinder 6 into the protection cylinder 5 until the collar member 22 comes into contact with the protection cylinder 5 in such a way that the coil spring 19 is fixed to the periphery of the guide cylinder 6, and finally, fitting the projecting members 11 and 11 into the coupling holes 10 and 10.

Figure 8:
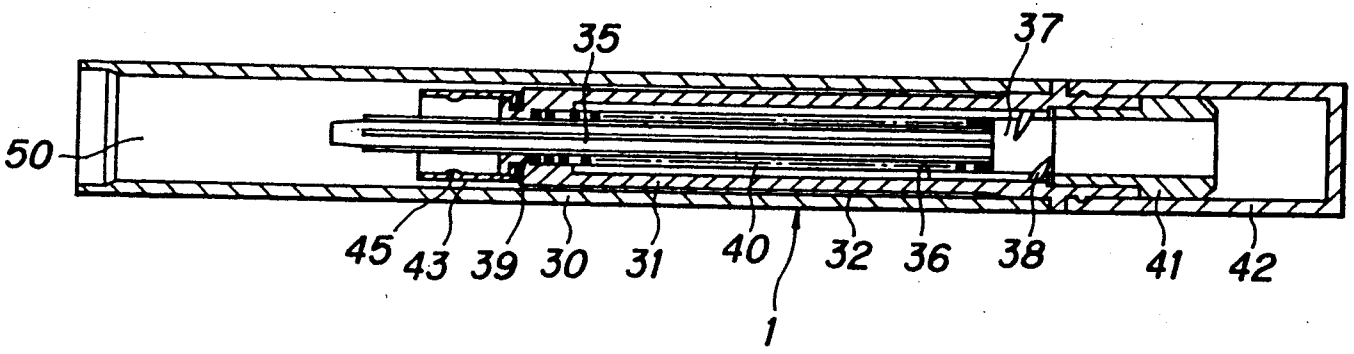
FIG. 8 illustrates a sectional view of the assembled container body.

As shown in FIG. 8, the internal cylinder 31 which extends from the rear to the middle portion inside the external cylinder 30 is provided for the container body 1 which allows the cartridge 2 to be freely inserted into and removed from it.

The insertion part 27 of the cartridge 2 is inserted into the cylinder body through the front aperture 50. As shown in FIG. 1, when the cartridge 2 is fully inserted, it takes up a position close to the step member 25 of the protection cylinder 5. The O-ring 24 in the vicinity of the step member 25 comes elastically into contact with the internal circumference of the external cylinder 30 with an appropriate pressure.

A plurality of vertical grooves extending in the axial direction are provided on the internal circumference of the external cylinder 30. A plurality of projections 33 extending in the axial direction on the external circumference of the internal cylinder 31 are coupled with these vertical grooves 32 to inhibit the relative rotation between the external and internal cylinders 30 and 31. These external and internal cylinders 30 and 31 are fixed together by means of an adhesive agent in such a way that the collar member 34 of the internal cylinder 31 remains in contact with the edge of the external cylinder 30.

Figure 9:
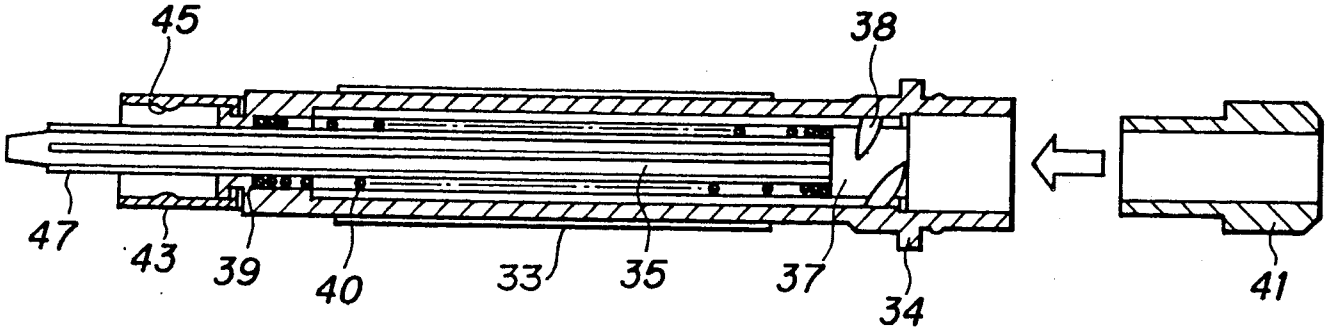
FIG. 9 illustrates a sectional view of the container body, where the push rod is loaded in the internal cylinder placed inside the container body.
Figure 10:
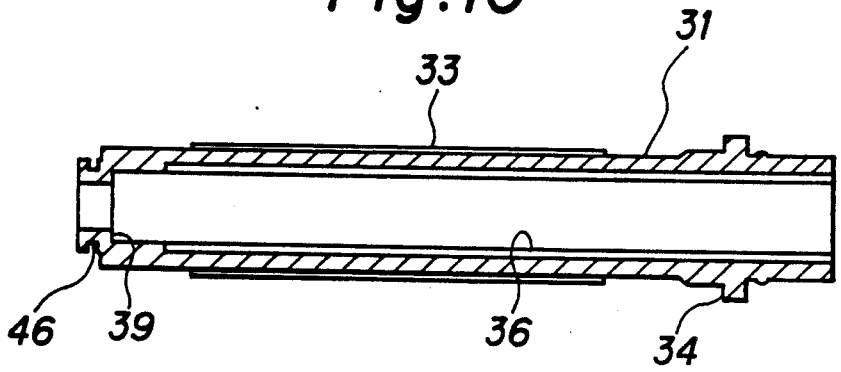
FIG. 10 illustrates a sectional view of the internal cylinder of the container body.
Figure 11:
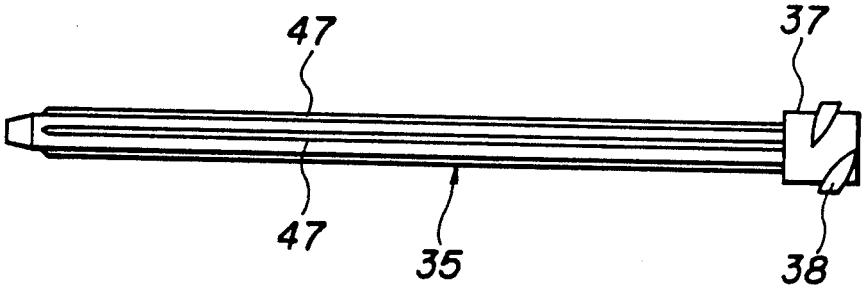
FIG. 11 illustrates a lateral view of the push rod.

As shown in FIGS. 8 through 10, the cosmetic-extrusion mechanism is composed by disposing the push rod (see FIG. 11) inside the internal cylinder 31, where the push rod 35 moves in the axial direction while rotating relatively with respect to the internal cylinder 31. A pair of spiral grooves 36 are provided on the entire length of the internal circumference of the internal cylinder 31. These spiral grooves are respectively coupled with the spiral projections 38 on the head 37 of the push rod 35.

Accordingly, when relatively rotating the push rod 35 against the internal cylinder 31, the push rod 35 moves in the axial direction in accordance with the pitch of the spiral grooves 36.

The coil spring 40 is installed outside the push rod 35. The coil spring 40 is installed between the throat portion of the head 37 of the push rod 35 and the step member on the front internal circumference of the internal cylinder 31 in a precompressed condition to elastically load the push rod 35 in the backward direction. As a result, as soon as the push rod 35 moving in the forward direction is freed from constraint, and due to the repulsion of the coil spring 40, the push rod 35 retracts to the rearmost position while rotating along the spiral grooves 36.

Plug 41 which is firmly coupled to the rear edge of the internal cylinder 31 comes into contact with the back of the head 37 of the push rod 35 to limit the rearmost position of the push rod 35. A cosmetic brush is attached to the plug 41. In addition, a protective cap 42 is also provided for the plug 41.

Figure 12:
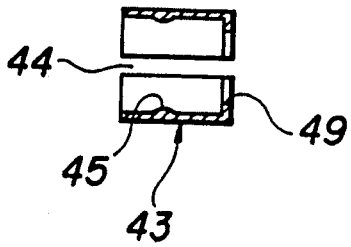
FIG. 12 illustrates a lateral view of the coupling ring.

The cylindrical coupling ring 43 shown in FIG. 12 is coupled to the ring-shaped groove 46 on the external circumference of the tip of the internal cylinder 31 via the collar member 49 which is fixed to the internal circumference of the edge of the internal cylinder 31.

Slit 44 is provided on the laternal surface of the cylindrical coupling ring 43 to allow the expansion of the inner diameter of the ring-shaped step member 45 on the external circumference of the guide cylinder 6 and also to allow the expansion of the inner diameter of the collar member 49 resulting from elastic deformation. The ring-shaped groove 46 is deeper than that of the collar member 49 to allow the coupling ring 43 to be securely inserted into and fixed to the tip of the internal cylinder 31.

As a result, the container body 1 can easily be assembled merely by implementing sequential steps including the insertion of the push rod 35 into the internal cylinder 31 together with the coil spring 40, engagement of the coupling ring 43 with the tip of the internal cylinder 31, and insertion of the coupling ring 43 into the external cylinder 30 in order that these can be glued together after first fixing the plug 41 at the rear end of the internal cylinder 31.

As shown in FIG. 6, the ring-shaped groove 23 is provided on the rear end of the guide cylinder 6 of the cartridge 2 behind the flange 22. When the cartridge 2 is inserted into the aperture 50 of the container body 1, the ring-shaped step member 45 of the coupling ring 43 engages with the ring-shaped groove 23 across the halfway steps, thus eventually composing the coupling member between the cartridge 2 and the container body 1.

A contact-friction force generated by the contact of the O-ring 24 with the internal circumference of the external cylinder 30 with an appropriate pressure is applied between the container body 1 and the cartridge 2 inserted into it. As described later on, the contact-friction force is counter balanced by the repulsive force of the coil springs 19 and 40 which is applied in the repulsive direction between the cartridge 2 and the container body 1.

When the cartridge 2 is fully inserted into the container body 1, the longitudinal relationship between the component members is properly set so that the tip of the push rod 35 inserted from the rear end of the guide cylinder 6 can approach the back of the chuck 7.

The inner spline teeth 26 are provided on the internal circumference of the guide cylinder 6 inside the ring-shaped groove 23. A plurality of projections 47 are provided over the entire length of the external circumference of the push rod 35 which engage with the inner spline teeth 26.

When the push rod 35 engages with the inner spline teeth 26, those projections 47 engage with these inner spline teeth 26. However, since the number of the projections 47 on the push rod 35 is less than that of the inner spline teeth 26, those projections 47 engage smoothly with these teeth 26, irrespective of the position of the rotation of the push rod 35.

As a result, the push rod 35 can move freely in the axial direction inside the guide cylinder 6. However, it cannot have a relative rotation with respect to the guide cylinder 6. Consequently, even when rotating the container body 1 relatively with respect to the cartridge 2, the push rod 35 remains still together with the cartridge 2.

Next, the functional movement of components of the cosmetic container embodied by the invention is described below.

When the cartridge 2 is inserted into the aperture 50 of the container body 1, the ring-shaped step member 45 of the coupling ring 43 is engages with the ring-shaped groove 23 of the guide cylinder 6 at the tip of the final insertion stage by being elastically deformed. Simultaneously, the O-ring 25 comes into contact with the internal circumference of the external cylinder 30 with an appropriate pressure so that the cartridge 2 can be inserted into the container body 1 in a modestly easy manner.

When the cartridge 2 is fully inserted into the container body, the tip of the push rod 35 engages with the inner spline teeth 26 of the guide cylinder 6.

When the container body 1 rotates relatively with respect to the cartridge 2, these engage with each other across the inner spline teeth 26 and the projections 47, and thus, the push rod 35 does not rotate. As a result, following the rotation of the container body 1 which contains the spiral groove 36, the push rod 35 moves in the axial direction to press the back of the chuck 7 inside of guide cylinder 6.

The chuck 7 moves forward through the slits 12 and 12, and extrudes part of the cosmetic 3 secured to the chuck 7 from the aperture 8 of the tip of the cartridge 2 (see FIG. 2). In this case, since the cosmetic 3 does not rotate relatively with respect to the guide cylinder 2, the cosmetic 3 is smoothly extruded along the guide cylinder 6 without incurring any damage.

When the rotation of the container body 1 is stopped, the push rod 35 instantly stops at the corresponding position. Since the coil spring 40 generates repulsion, the angular force corresponding to the spiral angle is transmitted to the push rod 35 and also to the cartridge 2. However, the angular force is balanced by the contactfriction force generated between the O-ring 25 of the cartridge 2 and the container body 1, thus eventually inhibiting the rotation of the cartridge 2. As a result, even if the user removes her fingers from the cartridge 2, the cartridge 2 does not rotate.

The cosmetic 3 can be retracted into the cartridge 2 through the rotation of the container body 1. When the push rod 35 returns to the initial position via the spiral groove 36, due to the presence of the repulsive force of the coil spring 19, the cosmetic 3 is retracted into the cartridge 2 together with the chuck 7.

The cartridge 2 can be removed pulling it from the container body 1 in the axial direction. Then, by reversing those processes thus far described, the ring-shaped groove 23 of the guide cylinder 6 is disengaged from the ring-shaped step member 45 of the coupling ring 43 before eventually allowing the user to remove the cartridge 2.

When the cartridge 2 is removed from the container body 1, the constraint thus far applied in the direction of the rotation of the push rod 35 is relieved. Simultaneously, the constraint against the chuck 7 is also relieved. As a result, due to the presence of the repulsive force of the coil spring 40, the push rod 35 automatically returns to the initial position while rotating and sliding along the spiral groove 36. Simultaneously, due to the presence of the repulsive force of the coil spring 19, the chuck 7 returns to the innermost position.

Accordingly, even when removing the cartridge 2 while the cosmetic 3 remains extruded from the cartridge 2, the positions of all the components of the cosmetic container are automatically initialized, and thus, there is no need for rotating the cartridge 2 back to the initial position before the user can replace the used cartridge with a new one.

What is claimed is:

1. A cosmetic container comprising;

an internal cylinder which is placed inside a container body and provided with a plurality of spiral grooves on the internal circumferential surface;

a push rod which moves in the axial direction inside of said internal cylinder under guidance of said spiral grooves;

a coil spring which loads said push rod in the retracting direction;

a cartridge which can be freely inserted into the container body in the axial direction;

a coupling member which couples said container body to said cartridge so that both of these can perform relative rotations;

a guide cylinder which is placed inside said cartridge and provided with a plurality of slits extending in the axial direction;

a chuck which holds the cosmetic and moves in the axial direction inside said guide cylinder under guidance of said slits;

a coil spring which loads said chuck in the innermost direction; and inner spline teeth which are provided on the internal circumference of said guide cylinder and engage with a plurality of projections provided on the external circumferential surface of said push rod;

wherein, when said cartridge is inserted into said container body, said push rod approaches the back of said chuck so that said chuck can be extruded following the relative rotation between said container body and cartridge.

2. The cosmetic container according to claim 1, comprising further an O-ring which is attached to the cartridge to insert a portion of said cartridge into said container body, and wherein said O-ring remains in contact with the internal circumference of said container body.

3. The cosmetic container according to claim 2, wherein the contact-friction force generated by said O-ring in contact with the internal circumference of said container body balances the axial repulsive and angular force between said cartridge and container body based on the repulsion of said coil spring.

4. The cosmetic container according to claim 1, wherein said guide cylinder is inserted into the protection cylinder protecting said cartridge, and wherein a plurality of projecting members provided for said guide cylinder are fitted in a plurality of coupling holes of said protection cylinder.

5. The cosmetic container according to claim 4, wherein said guide cylinder is provided with a pair of cutout windows at a position crossing at right angle said pair of projecting members so that said guide cylinder can be easily and elastically deformed in the inward direction by means of said projecting members.

6. The cosmetic container according to claim 4, wherein said guide cylinder is provided with a pair of slits which extend in the axial direction, and wherein said guide cylinder slits guide a pair of projecting members provided for said chuck.

7. The cosmetic container according to claim 6, wherein said guide cylinder is made of an elastically deformable material and loads said chuck in said guide cylinder via said pair of slits having a width that can be expanded by elastic deformation.

8. The cosmetic container according to claim 7, wherein said coil spring loads said chuck in the direction of an initial position and installed outside said guide cylinder and between said pair of projecting members and a step member on an internal circumference of said cartridge in a precompressed condition.

9. The cosmetic container according to claim 1, wherein the rear-edge of said internal cylinder of said container body is blocked by a plug, with which the retracting position of said push rod is constrained.

10. The cosmetic container according to claim 9, wherein a plurality of spiral projections provided on the head of said push rod are coupled to said spiral grooves on the internal circumferential surface of said internal cylinder.

11. The cosmetic container according to claim 10, wherein said coil spring which loads said push rod is installed outside said push rod and is positioned between the head of said push rod and a step member on an internal circumference of said internal cylinder in a precompressed condition.

12. The cosmetic container according to claim 1, wherein the number of said projections on the external circumferential surface of said push rod engage said inner spline teeth provided on the internal circumference of said guide cylinder allowing entry of said push rod is less than that of said inner spline teeth.

13. The cosmetic container according to claim 1, wherein said coupling member coupling said cartridge to said container body is composed mainly of a coupling ring fixed to the tip of said internal cylinder and a ring-shaped groove provided on the external circumference at the rear edge of said guide cylinder.

14. The cosmetic container according to claim 13, wherein said coupling ring is coupled to said ring-shaped groove at the tip of said internal cylinder via a collar member attached to the edge of said coupling ring.

15. The cosmetic container according to claim 14, wherein a slit is provided on the lateral surface of said coupling ring, and wherein the inner diameters of said ring-shaped step member on the internal circumference of said ring and said collar member can be elastically expanded.

16. The cosmetic container according to claim 15, wherein, when said cartridge is fully inserted into said container body, said ring-shaped step member on the internal circumferential surface of said coupling ring is coupled to said ring-shaped groove on the external circumferential surface at the rear end of said guide cylinder while being elastically deformed halfway across those steps members.

* * * * *